United States Patent [19]

Kock

[11] Patent Number: 5,037,006

[45] Date of Patent: Aug. 6, 1991

[54] SQUEEZE BOTTLE FOAM DISPENSER WITH THRESHOLD PRESSURE VALVE

[75] Inventor: Ronald W. Kock, Wyoming, Ohio

[73] Assignee: The Procter & Gamble Company, Cincinnati, Ohio

[21] Appl. No.: 500,178

[22] Filed: Mar. 27, 1990

[51] Int. Cl.[5] ..... B67D 5/58

[52] U.S. Cl. ..... 222/190; 222/211; 222/212; 222/496; 239/343

[58] Field of Search ..... 222/129, 135, 136, 145, 222/189, 190, 206, 207, 209, 211, 212, 213, 491, 495, 496, 481, 481.5; 239/327, 328, 330, 343

[56] References Cited

U.S. PATENT DOCUMENTS

| | | | |
|---|---|---|---|
| 2,119,906 | 6/1938 | Dorman | 222/190 X |
| 2,514,107 | 7/1950 | Trostler | 239/343 X |
| 3,422,993 | 1/1969 | Boehm et al. | 222/190 |
| 3,488,002 | 1/1970 | Mina | 239/327 |
| 3,709,437 | 1/1973 | Wright | 239/343 |
| 3,937,364 | 2/1976 | Wright | 222/190 |
| 3,963,150 | 6/1976 | Steiman et al. | 222/211 |
| 4,018,364 | 4/1977 | Wright | 222/190 |
| 4,122,979 | 10/1978 | Laavwe | 222/211 X |
| 4,345,718 | 8/1982 | Horvath | 239/333 |
| 4,477,000 | 10/1984 | Arabian | 222/190 X |
| 4,531,659 | 7/1985 | Wright | 222/190 |
| 4,596,343 | 6/1986 | Ford, Jr. | 222/190 |
| 4,640,440 | 2/1987 | Ford, Jr. et al. | 222/190 |
| 4,836,422 | 6/1989 | Rosenberg | 222/190 |
| 4,930,668 | 6/1990 | Krall | 222/212 |
| 4,932,567 | 6/1990 | Tanabe et al. | 222/190 |

*Primary Examiner*—Kevin P. Shaver

*Attorney, Agent, or Firm*—R. C. Witte; J. V. Gorman; M. E. Hilton

[57] ABSTRACT

A squeeze bottle foam dispenser with improved foam consistency throughout the range of manual squeeze conditions. The foamer includes a pressure operated valve for simultaneously restricting flow of the compressible and incompressible fluids until a predetermined threshold pressure is developed within the bottle by manual deformation thereof. Thus, foam is not dispensed from the container until a pressure is developed within the bottle sufficient to produce a desirable foam. The disclosed foamer is for storage and operation in the inverted orientation. This avoids the necessity of an extended spout and its concomitant problems.

20 Claims, 3 Drawing Sheets

SQUEEZE BOTTLE FOAM DISPENSER WITH THRESHOLD PRESSURE VALVE

FIELD OF THE INVENTION

The present invention relates to liquid dispensers, and more particularly to foamable liquid dispensers, wherein air and a foamable liquid from within the dispenser are mixed to generate a foam. Even more particularly, the present invention relates to such dispensers which are of the hand held squeeze bottle type.

BACKGROUND OF THE INVENTION

Foam may be technically defined as a physical mixture of a compressible fluid and an incompressible fluid in such a manner that bubbles are formed. The degree of mixing and work put into the system determines the size and dispersion of bubbles. A lather is a specific form of foam with uniformly small bubbles that is recognized for its penetration and cleaning ability on soiled surfaces. Lathering generally requires considerable mechanical working of a foamable material. For example, a bar of soap or liquid soap can be mixed with water in the hands and worked for 10 seconds or so to produce an effective lather.

Alternatives to manually working bar and liquid soaps may become popular because of the convenience offered in reducing the time and energy required to generate a lather. Aerosol foam generators, for example, mix a propellant with a foamable liquid to produce a rich foam. However, aerosols are increasingly unpopular because of their cost and negative environmental impact.

Another, more cost effective, alternative to generating and dispensing a foam is to use hand held squeeze bottle dispensers. Inexpensive squeeze bottle foam dispensers have been developed by a number of individuals. Squeeze-bottle foamers, such as those described in Boehm et al. U.S. Pat. No. 3,422,993, Wright U.S. Pat. Nos. 3,937,364, 4,018,364, and 4,531,659, use hand squeezing force and a deformable squeeze bottle to mix air with a foamable liquid inside the bottle and then force the mixture through a porous homogenizer to generate small bubbles.

Unfortunately, currently existing squeeze bottle foam dispensers have several drawbacks. The most troubling drawback involves inconsistency in the foam's characteristics. One reason for foam inconsistency is that some individuals squeeze the foam dispensers with a great deal of force which results in a high squeeze rate and high bottle pressure while others squeeze more gingerly resulting in a relatively low squeeze rate and bottle pressure. This variation in the squeeze rate and the pressure developed within the bottle results in variation in the consistency and overall quality of the foam dispensed. As a result a poor runny foam is frequently produced rather than the desired lather.

Additionally, there are several drawbacks which are a direct result of the storage and operation of current squeeze bottle foam dispensers in an upright orientation. The upright orientation necessitates spouts which extend horizontally or downwardly because foam is normally dispensed into an upward-facing palm. These spouts have a certain length. Often a considerable amount of foam remains throughout the length of the spout after dispensing and condenses in time. This condensate either drips out of the spout as a liquid or forms a residue which gradually plugs up the spout. Other problems which result from the upright operating and storage orientation include the inability to dispense a foam if the bottle is tilted such that the diptube is no longer submerged, and the difficulty in dispensing any foamable liquid located below the diptube as the bottle becomes empty.

OBJECTS OF THE INVENTION

It is a principle object of the present invention, therefore, to provide a hand held squeeze bottle foamer with improved foam consistency throughout the range of manual squeeze conditions.

It is a further object of the present invention is to produce a foam which is as close to the wetness and richness of lather as possible.

It is likewise an object of the present invention to provide a dispenser that is both stored and used in an inverted orientation; thereby avoiding the requirement of a spout which minimizes the messiness associated with foam being left in the spout after dispensing.

It is an additional object of the present invention to provide a dispenser that is used in the inverted orientation; thereby minimizing the amount of liquid in the bottle that can not be removed as a high quality foam.

It is also an object of the present invention to accomplish the aforementioned objectives at minimal cost.

SUMMARY OF THE INVENTION

In accordance with one aspect of the present invention there is provided a squeeze bottle foam dispenser. This dispenser includes a manually deformable bottle which is adapted to contain a compressible fluid in a head space and an incompressible foamable fluid. The bottle has an opening located therein. Inserted into the opening in the bottle is a housing which has an incompressible fluid passage, a compressible fluid passage and a dispensing passage. A means is interposed between the dispensing passage and the incompressible and compressible fluid passages which simultaneously restricts flow from the incompressible fluid passage and the compressible fluid passage to the dispensing passage until a predetermined threshold pressure is developed within the bottle by the manual deformation thereof. The dispenser also has a means for converting the mixture of fluids in the dispensing passage to a foam prior to exiting the dispensing passage of the housing.

DETAILED DESCRIPTION OF THE INVENTION

Figure 1:
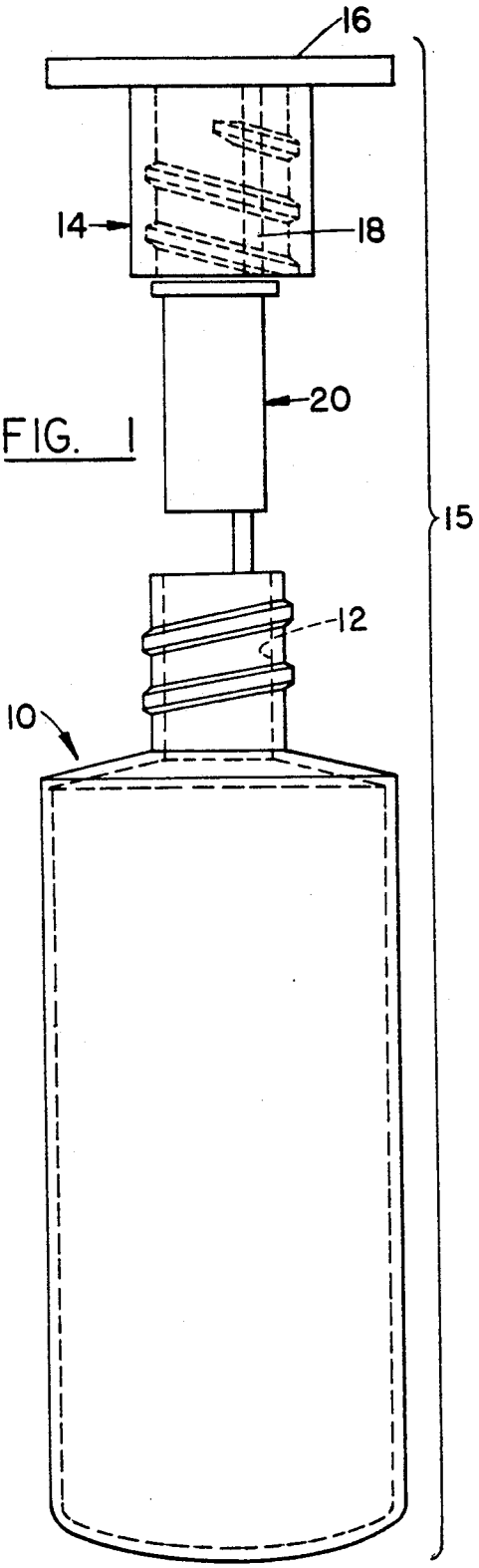
FIG. 1 is an exploded elevation view of a squeeze bottle foamer of the present invention.

In a particularly preferred embodiment shown in FIG. 1, the present invention is a hand held squeeze bottle foamer, indicated generally as 15, for housing a compressible fluid and an incompressible fluid, and dispensing a mixture of these fluids as a foam. The foamer 15 of the preferred embodiment consists essentially of a squeeze bottle 10, a housing 20 and a closure 14.

The squeeze bottle 10 is a preferably oval bottle 10 with a rounded bottom and manually deformable side walls. Centered on the bottle 10 is an externally threaded finish with a cylindrical inside surface 12. The inside surface 12 of the finish of the bottle 10 is adapted for receiving the flanged foam generator housing 20, preferably by means of a fluid-tight interference fit. Alternatively, attachment of the housing 20 to the surface 12 of the bottle 10 may be achieved by a threading means in order that the housing 20 might be removable from the bottle 10 for liquid refill purposes. In any event, when the flexible side walls of the bottle 10 are squeezed to pressurize the inside of bottle 10, the foam generator housing 20 remains affixed to the bottle 10 in a leak-tight manner.

In the preferred embodiment of the present invention, the bottle 10 is fitted with the threaded closure 14. The threaded closure 14 preferably has a flange 16 at its outer end. This flange 16 is preferably circular in shape with a flat face perpendicular to the axis of the finish of the bottle 10. The rounded bottom of the bottle 10 encourages storage of the foamer 15 in its intended inverted orientation on the flange 16 of the closure 14 when not in use. Alternatively, a larger diameter finish on the bottle 10 may serve as the inverted orientation support so that the closure 14 is needed only for sealing the bottle 10 during transport, for example.

Figure 2:
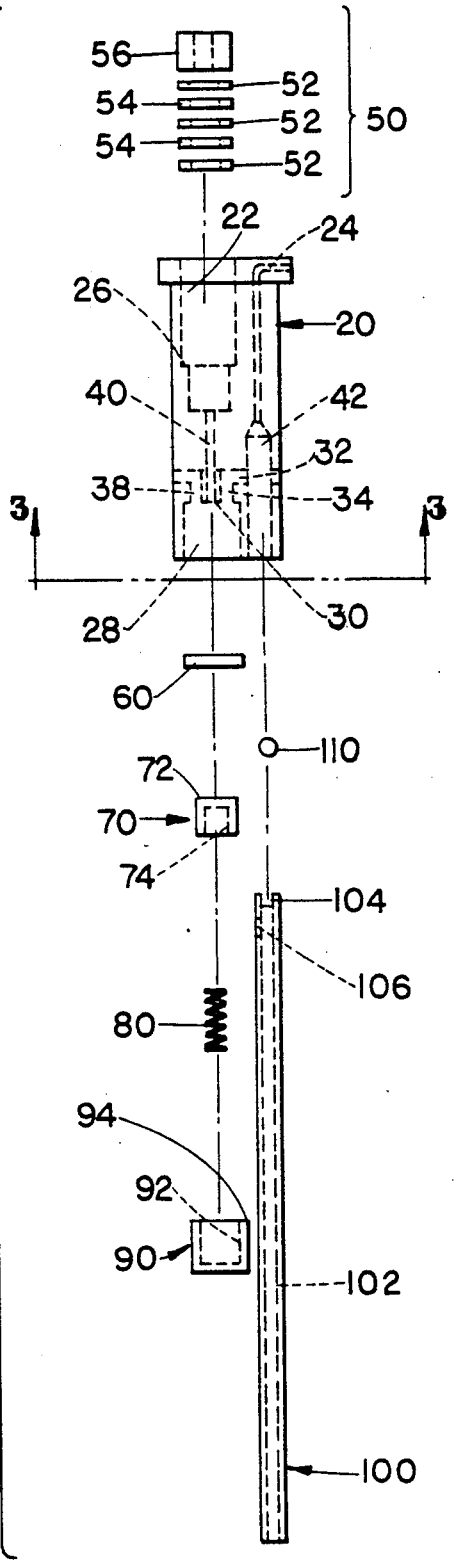
FIG. 2 is an exploded elevation view of the housing and its related components used in the squeeze bottle foamer of FIG. 1.

FIG. 2 illustrates the assembly of the foam generator housing 20 of the preferred embodiment. The housing 20 has several components attached thereto including foam homogenizer 50, a diaphragm 60, a piston 70, a spring 80, a plug 90, a diptube 100, and a checkball 110. These components are preferably received within several bores located within the housing 20. Extending from the flanged end of the housing 20 is a relatively large stepped bore 22 offset from the central axis of the housing 20. At the non-flanged end of the housing 20 is a bore 28 which has a preferably flat bottom surface 30, substantially perpendicular to the center line of the bore 28. The flat bottom bore 28 communicates with the stepped bore 22 through a relatively small concentric bore 40. The stepped bore 22 and the relatively small bore 40 in combination form a dispensing passage.

A means for forming foam is received within the stepped bore 22 and is supported by the shoulder 26 of the bore 22. The means of the preferred embodiment is a homogenizer 50, which includes 3 porous screens 52 spaced apart by two spacer rings 54 and a final ring 56. Each spacer 54 is an annular ring which is adapted to hold the edges of the screens 52. The internal diameter of the final ring 56 is preferably smaller than the internal diameter of the spacers 54. The spacers 54 and the screens 52 are secured in place against the shoulder 26 by the final ring 56, which is connected to the stepped bore 22 preferably by an interference fit. Thus, the homogenizer 50 is held between the shoulder 26 and the final ring 56. Alternatively, the homogenizer 50 can have as many screens 52 as desired or as few as one. These screens 52 may also be placed in face-to-face relationship without the spacers therebetween. Even some combination of spaced and adjacent screens of varying sizes would be acceptable.

The flat bottom bore 28 receives the diaphragm 60, the piston 70, the spring 80, and the plug 90. The diaphragm 60 is a thin flexible circular diaphragm 60. The diaphragm 60 is assembled into the foam generator housing 20 against the flat bottom surface 30 (seen best in FIG. 3) of the bore 28. A cylindrical piston 70, is installed behind the flexible diaphragm 60 with a flat surface 72 against the diaphragm 60. This piston 70 has an annular wall 74 depending from the circular horizontal wall with a flat surface 72. A helical compression spring 80 fits loosely within the annular wall 74 of the piston 70.

The cylindrical plug 90 supports the other end of the helical compression spring 80 such that it is pre-loaded to press the piston 70 and consequently, the diaphragm 60, against the flat surface 30 of the flat bottom bore 28 creating a valve. The plug 90 has a shape similar to that of the piston 70, although the inner diameter of its annular wall 92 is slightly greater than the outer diameter of the annular wall 74 of the piston 70. Consequently, the piston 70 slides freely within the annular wall 92 of the plug 90. When assembled, the annular surface 94 of the plug 90 presses against the peripheral edge of the diaphragm 60 to secure it to the flat surface 30. The plug 90 is connected to the flat bottom bore 28 preferably by a fluid-tight interference fit. In addition to holding the diaphragm 60 in place this configuration seals piston 70 from the contents of the foamer 15. Alternatives to the spring 80 arrangement include: the peripheral clamping of the diaphragm 60 below the flat surface 30 so that the diaphragm 60 is stretched over the flat surface 30; doming the surface 30 so that again the diaphragm 60 is stretched over it; or simply using a thick diaphragm 60 that seals the surface 30 by virtue of its rigidity.

Next to the flat bottom bore 28 is a substantially parallel 45° countersink bore 42. The countersink bore 42 receives a checkball 110 and a diptube 100. The diptube 100 is secured to the countersink bore 42 preferably by a fluid tight interference fit. The 45° taper of the countersink bore 42 serves as the seat for the checkball 110 such that a one way valve is created. The spherical checkball 110 is placed in the countersink bore 42 prior to the insertion of the diptube 100 into the foam generating housing 20. The diptube 100 has a passage 102 extending through its entire length. The tip of the diptube 100 which is inserted into the countersink bore 42 has a notch 104. The notch 104 permits air to pass from a vent passage 24 through the passage 102 in the diptube 100 when the checkball 110 rests against the diptube 100. A hole 106 extends through one wall of the diptube 100 near the notched end of the diptube 100. When diptube 100 is inserted into the countersink bore 42 to the intended depth and with the intended o orientation, the hole 106 lines up with compressible fluid passage 32. The outer portion of the compressible fluid passage 32 is blocked by the diptube 100.

Concentric with the countersink bore 42 is an air vent passage 24 which extends from the tapered end of the countersink bore 42 and exits out the side of the flange of the housing 20. The exit of the vent passage 24 is preferably located well away from the exit of the foam dispensing passage. In order to vent air to the bottle 10 when the closure 14 is installed, a groove 18 in the closure 14, shown in FIG. 1, connects hole 24 to the ambient air outside of the foamer 15.

Figure 3:
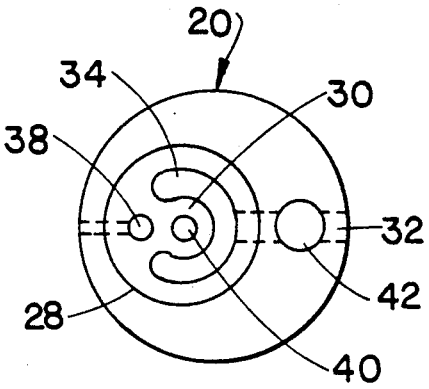
FIG. 3 is an enlarged end view of the housing of FIG. 2 showing the inner end of the housing.

FIGS. 2 and 3 together illustrate additional features of the foam generator housing 20. The flat bottom surface 30 of bore 28 has a 240° radial annular groove 34 which is the vertical section of the bore 32 which is also the terminal end of the bore 32 which serves as a compressible fluid passage. When the foamer 15 is in the dispensing orientation and mode, this compressible fluid passage 32 communicates the compressible fluid region within the foamer 15 with the flat bottom bore 28. An additional bore 38 serves as an incompressible fluid passage and when the foamer 15 is in the dispensing orientation and mode, this incompressible fluid passage 38 communicates the incompressible fluid region within the foamer 15 with the flat bottom bore 28. The radial annular groove 34 at the terminal end of the compressible fluid passage 38 in surface 30, shown in FIG. 3, and the terminal end of the incompressible fluid passage 38 are located inwardly of the annular clamping area of surface 94 so that fluid pressure through the passages 32 and 38 will lift the diaphragm 60. Additionally, the originating end of the fluid passages 32 and 38 exit the housing 20 an axial distance from the flange such that they are inside the bottle 10 beyond the finish surface 12 when the foamed generator housing 20 is installed. This configuration allows these passages 32 and 38 to pass their respective fluids out of the foamer 15 through the dispensing passage.

Figure 5:
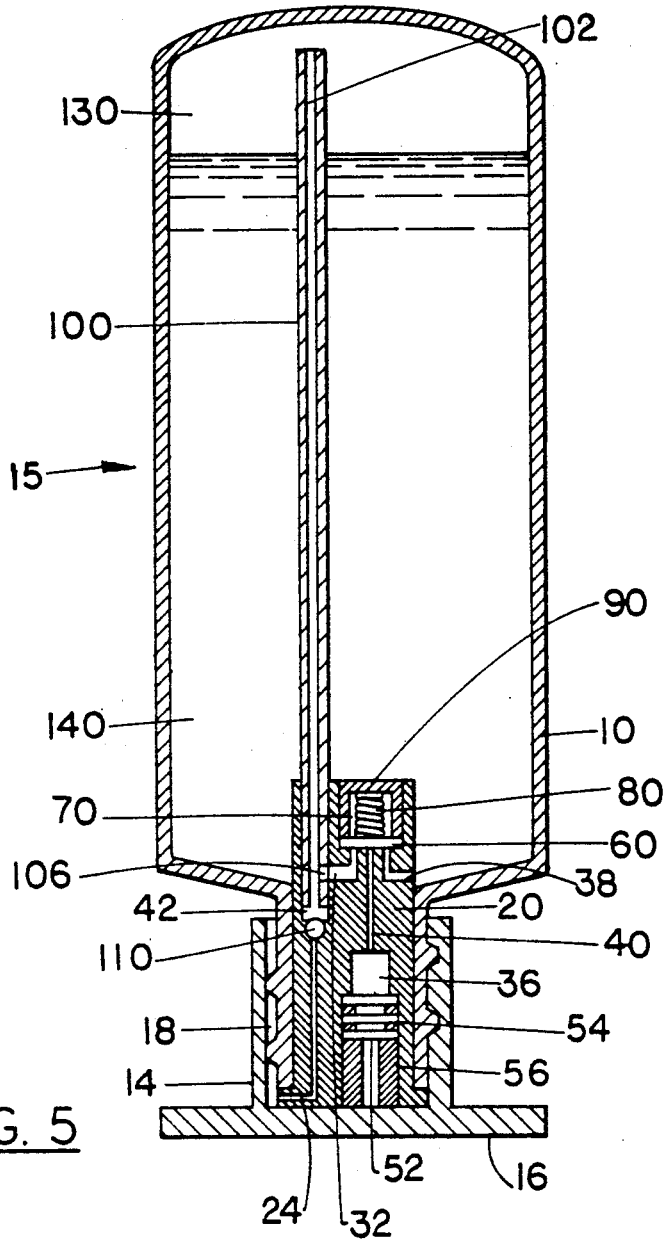
FIG. 5 is a cross-sectional elevation view of the squeeze bottle foamer of FIG. 1, taken through line 5—5 of FIG. 4.
Figure 4:
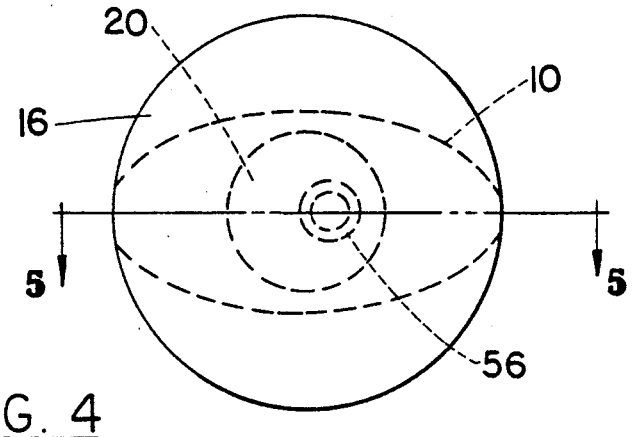
FIG. 4 is bottom plan view of the squeeze bottle foamer of FIG. 1.

Referring now to FIGS. 4 and 5, the foamer 15 contains an incompressible fluid 140 which is preferably a foamable liquid and a compressible fluid 130 which is preferably air, trapped in the head space of the bottle 10. The foamer 15 is shown in the preferred storage position, inverted and resting on the flat surface 16 of the closure 14. The compressible fluid 130 and the incompressible fluid 140 are both prevented from discharging from the foamer 15 by the spring 80 which presses the piston 70, and consequently, the diaphragm 60 against the surface 30. Prior to operation, the fluids 130 and 140 are in communication with the diaphragm 60. The incompressible fluid 140 is in communication via the incompressible fluid passage 38 and the compressible fluid is in communication via the diptube 100, diptube hole 106 and the compressible fluid passage 32.

Figure 6:
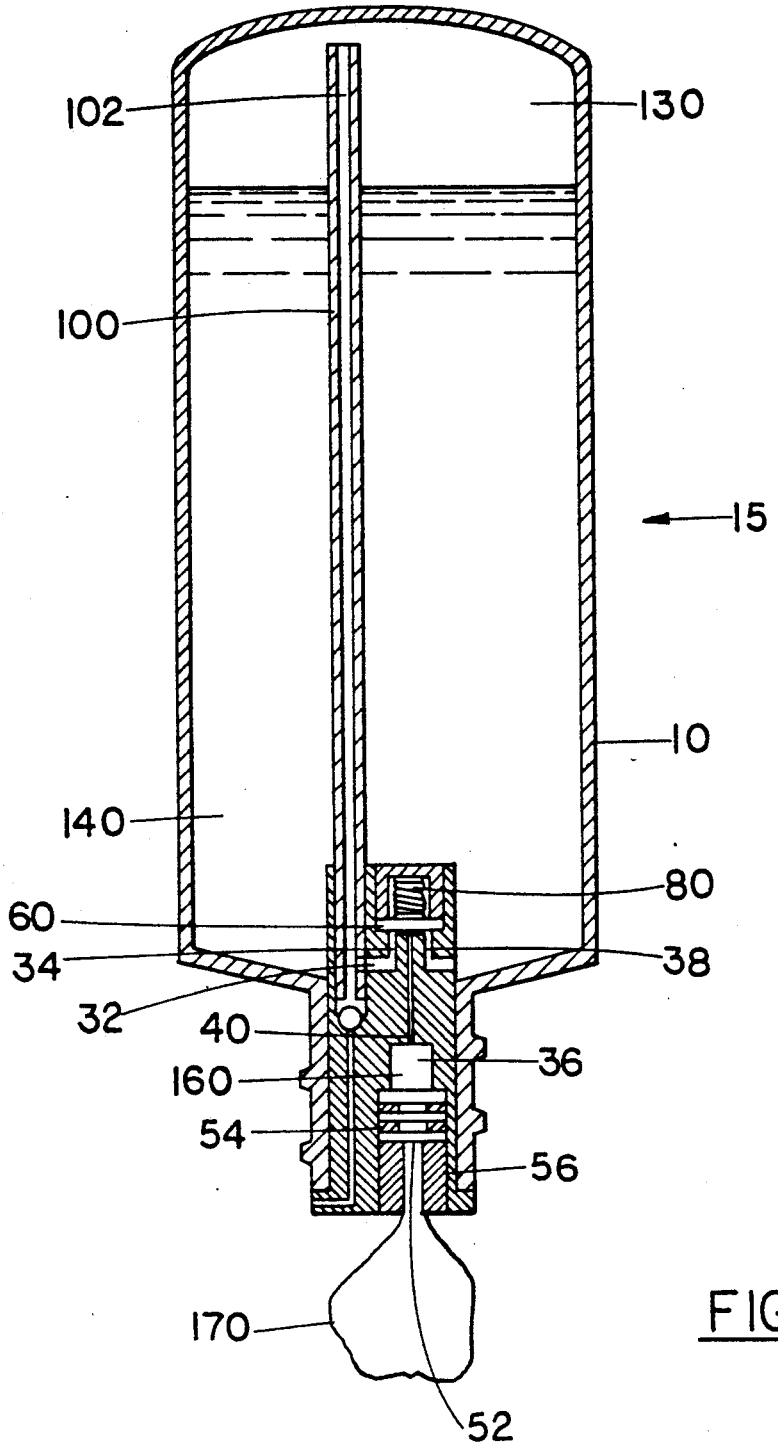
FIG. 6 is a cross-sectional elevation view similar to FIG. 5 with the closure removed and the squeeze bottle foamer in the operating condition.

Referring to FIG. 6, the foamer is operated by removing the closure 14 and manually compressing the side walls of the bottle 10. The compression causes an increase in pressure within the bottle 10. Since the checkball 110 is held by gravity against its 45° tapered seat of the countersink bore 42 creating a seal, the pressure increases within the bottle 10 until a threshold pressure is reached within the foamer 15. Neither the compressible fluid 130 nor the incompressible fluid 140 can pass to the bore 40 until enough pressure is generated in the squeeze bottle 10 to cause the diaphragm 60 to be lifted off the surface 30. Once the threshold pressure is reached the diaphragm 60 is forced away from the surface 30 which allows the fluids 130 and 140 to simultaneously exit the foamer 5 through the dispensing passage.

The squeeze bottle foamer 15 with the closure 14 removed is shown in its squeezed condition in FIG. 6, whereby foam is being discharged. The pressure developed inside the bottle 10 is greater than the threshold pressure. Therefore, the compressible fluid 130 in radial annular groove 34 and the incompressible fluid 140 in the incompressible fluid passage 38 generate sufficient force to overcome the pre-load of the spring 80, thereby lifting diaphragm 60 away from the surface 30. The cross-sectional area of the incompressible fluid passage 38 and the radial annular groove 34 combined, times the pressure developed inside bottle 10 equals the lifting force. In the preferred embodiment, the cross-sectional area of the compressible fluid 130 pressing on the diaphragm 60 via the radial annular groove 34 is larger than the cross-sectional area of the incompressible fluid 140 pressing on the diaphragm 60. Consequently, the compressible fluid 130 presses upon the diaphragm 60 with more force than the incompressible fluid 140. This helps insure the proper ratio of compressible fluid 130 to incompressible fluid 140 in the resulting foam. The ratio of these cross-sectional areas can be changed to accommodate various incompressible fluids or create foams with various characteristics.

The preferred total pre-load force pressing upon the diaphragm 60 by the spring 80 ranges from 0.01 to 0.10 pounds, and even more preferably from 0.04 to 0.06 pounds. This force requires a threshold pressure of preferably from about 0.26 PSI to about 2.6 PSI and even more preferably from about 1.04 PSI to about 1.56 PSI to be developed within the bottle 10 before any fluid will be dispensed. It is this threshold condition which produces the important benefit of a substantially constant density foam through the squeeze stroke. Without the threshold pressure, compressible fluid 130 and incompressible fluid 140 could dribble through the foam homogenizer with low initial squeeze pressure producing a heavy, wet, runny foam, while near the end of the stroke under a higher squeeze pressure, a light, dry preferred density foam would be produced. This threshold pressure reduces the variation in pressure at which foam will be produced, and therefore, it reduces the variation in the foam quality.

When the foamer 15 is no longer squeezed, the spring 80 forces the diaphragm 60 to return against the flat surface 30 of bore 28 and foam generation is discontinued. When the flexible sidewalls of the bottle 10 are released, their molded-in memory provides a force to return them to their original non-squeezed position. In order to return, the fluid discharged as foam must be replaced. Both compressible 130 and incompressible 140 fluids were discharged, but air is the preferred replacement fluid because of its presumed immediate availability. Therefore, the foamer 15 is vented to the atmosphere through the one way valve created by the checkball 110 and the 45° taper of countersink bore 42. The suction created inside the bottle 10 by the force of the flexible sidewalls lifts checkball 110 from its seat and permits air to enter the foamer 15 via vent passage 24 and compressible bore 42. The notch 104 in the diptube 110 prevents the checkball 110 from blocking the passage 102 through the diptube 110. Thus, air passes checkball 110 and passes through the diptube passage 102 to the head space 130, thereby replacing the discharged fluids.

After use of the preferred embodiment of the current invention, any foam that had occupied the dispensing passage would gradually condense to form liquid. The closure 14 seals the dispensing passage so that such liquid cannot drip out between dispensing operations. Meanwhile, air may enter the foamer 15 to replenish the head space by passing through the groove 18 in the closure 14, through the vent passage 24 in the housing 20, past the checkball 110, through the diptube 100 and into the head space. Alternatively, the bottle 10 sidewalls would have enough molded-in memory to create a force sufficient to replenish the head space before the closure 14 can be replaced, thereby eliminating the need for the groove 18 in the closure 14.

If the foamer 15 were inadvertently tilted or turned upright prior to the inverted dispensing of foam such that the incompressible fluid 140 could enter the diptube 100, foam would not be immediately dispensed. When first squeezed, incompressible fluid would flow through both the incompressible fluid passage 38 and the compressible fluid passage 32. As a result, substantially no foam would be produced. However, after all the incompressible fluid 140 from the diptube 100 was discharged, and compressible fluid 130 was again available in groove 34, further squeezing would result in foam being dispensed. This problem could be solved by simply adding a one way check valve at the distal end of the diptube 100, thereby preventing the escape of compressible fluid 30 from the passage 102 when the foamer 15 is tilted or turned upright.

If the foamer 15 were squeezed in the upright orientation, incompressible fluid 140 would be lifted through diptube 100 while compressible fluid 130 would flow through the incompressible fluid passage 38. If the threshold pressure were overcome, allowing the fluids 130 and 140 to pass to the dispensing passage, foam would be produced. However, the foam might not have the preferred characteristics. The foam would likely be wetter than that produced by the bottle 10 in an inverted orientation because the passages are sized for compressible fluid passing through diptube 100 and incompressible fluid passing through passage 38. It is to be understood that, as with many commercially available devices, the passages could be sized in the reverse manner thereby providing the preferred operation of the foamer in the upright orientation.

In the preferred embodiment of the present invention, the foam homogenizer 50 is preferably an assembly of thread 0.375 inch diameter Fluortex #90-70/22-879 fine mesh screens 52, made by Tetko, Inc. These screens 52 are stacked face-to-face, perpendicular to their common axis and spaced 0.06 inches apart by the spacer rings 54. The spacer rings 54 have a 0.25 inch internal diameter. The final ring 56 is rigid and has a 0.376 inch external diameter and a 0.125 inch internal diameter. The final ring 56 secures the screens 52 and the resilient spacer assembly into the stepped bore 22 of housing 20 by means of an interference fit. Alternatively, foam homogenizer 50 is a 0.376 inch diameter by 0.50 inch long porous polymer cylinder which is assembled into the stepped bore 22 of housing 20 and held in place by means of an interference fit.

In either homogenizer 50 design, compressible fluid 130 and incompressible fluid 140, preferably air 130 and a foamable liquid 140, are mixed ahead of the homogenizer in the passage 40 and the chamber 36 immediately before the homogenizer 50. By passing this mixture through the small holes of the homogenizer 50, many small air bubbles are formed from the incompressible fluid 140. It is the mixture of very small bubbles, substantially uniformly distributed in the liquid, that defines the foam.

Many factors affect bubble size and foam density. The liquid properties of the incompressible fluid 140, including surface tension and viscosity, are among these factors. Also a factor is the volumetric ratio of compressible 130 to incompressible 140 fluids. Additionally, the rate of flow through the homogenizer 50 can affect bubble size and foam density. In the preferred embodiment the formulation of the incompressible fluid 140 in solution percent is: 5% myristoyl glutamate, 5% lauramide DEA, 2.5% cocamidopropyl betaine (30%), 2.5% sodium n-lauroyl sarcosinate (30%), 0.2% quatemium-15, 0.05% delaire, and 84.75% water.

The bottle 10 is preferably a 6 oz. oval container filled such that initially at least 15% of its volume is head space for air (the compressible fluid 130). The housing 20 is preferably an injection molded high density polyethylene cylinder having a body diameter of at least 0.6 inches and sized to interference fit the finish of the bottle 10. The housing 20 body length is preferably at least 1.75 inches for a 1 inch long bottle finish. The finish is preferably 0.125 inches thick and has a diameter 0.06 inches less than the root diameter of the finish treads. The closure 14 has an internal axial groove 18 which is preferably 0.1 inches wide with a depth 0.03 inches deeper than the thread root depth.

The preferred dimensions of the bores in the flanged housing 20 are as follows:

- Stepped bore 22: 0.375 inches diameter×0.5 inches deep (outer section) and 0.25 inches diameter×0.25 inches deep (inner section);
- Bore 40: 0.09 inches diameter×0.5 inches long;
- Flat bottom bore 28: 0.375 inches diameter×0.5 inches deep;
- Compressible fluid passage 32: 0.09 inches diameter;
- Incompressible fluid passage 38: 0.06 inches diameter (horizontal section) and 0.09 inches diameter×0.188 inches long (vertical section);
- air vent passage 24: 0.09 inches diameter;
- Countersink bore 42: 0.156 inches diameter×0.875 inches deep; and
- Radial annular groove 34: 0.06 inches wide×0.188 inches deep.

The diaphragm 60 is preferably a 0.005 inch thick×0.375 inch diameter circle of latex rubber. The piston 70 is preferably an injection molded low density polyethylene cylinder, 0.25 inches long ×0.27 inches outside diameter, with a 0.03 inch thick by 0.188 inch long annular wall 74. The spring 80 is preferably a Century Spring Corporation model no. S-900 helical compression spring wound from stainless steel wire, with a free length of 0.59 inches and a spring rate of 0.13 pounds per inch. The plug 90 is preferably an injection molded high density polyethylene cylinder 0.438 inches long×0.376 inches outside diameter, with an annular wall 0.0475 inches thick×0.375 inches long. The diptube 100 is preferably an extruded low density polyethylene tube with a 0.156 inch outside diameter x a length putting it 0.25 inches from the bottle 10 bottom when assembled. The holes 102 and the passage 102 in the diptube 100 are preferably 0.09 inches diameter. The diptube 100 notch 104 is preferably 0.09 inches wide×0.09 inches deep. Checkball 110 is preferably a 0.125 inch diameter sphere made of stainless steel.

It is thought that the inverted squeeze bottle foam dispenser 15 of the present invention, and many of its attendant advantages, will be understood from the foregoing description; and it will be apparent that various changes may be made in form, construction, and arrangement without departing from the spirit and scope of the invention or sacrificing all of its material advantages, the forms hereinbefore described being merely preferred or exemplary embodiments thereof. Accordingly the present invention comprises all embodiments within the scope of the appended claims.

What is claimed is:

1. A foam dispenser comprising:

(a) a manually deformable bottle being adapted to contain a compressible fluid in a head space and an incompressible foamable fluid, said bottle having an opening therein;

(b) a housing inserted into said opening in said bottle, said housing having an incompressible fluid passage, a compressible fluid passage and a dispensing passage;

(c) means interposed between said dispensing passage and said incompressible and compressible fluid passages for simultaneously restricting flow from said incompressible fluid passage and said compressible fluid passage to said dispensing passage until a predetermined threshold pressure is developed within said bottle by manual deformation thereof; and (d) means for converting the mixture of fluids in said dispensing passage to a foam prior to exiting said dispensing passage of said housing.

2. A foam dispenser according to claim 1 wherein said means interposed between said dispensing passage and said incompressible and compressible fluid passages for simultaneously restricting flow from said incompressible fluid passage and said compressible fluid passage to said dispensing passage until a predetermined threshold pressure is developed within said bottle by manual deformation thereof comprises a diaphragm biased against a surface having the terminal end of each of said incompressible fluid passage and said compressible fluid passages located therein, and the originating end of said dispensing passage located therein; said diaphragm operating as a valve selectively allowing flow from the incompressible and compressible fluid passages to the dispensing passage only after a threshold pressure is developed within said bottle.

3. A foam dispenser according to claim 2 wherein said means interposed between said dispensing passage and said incompressible and compressible fluid passages for simultaneously restricting flow from said incompressible fluid passage and said compressible fluid passage to said dispensing passage until a predetermined threshold pressure is developed within said bottle by manual deformation thereof further comprises a piston biased against said diaphragm by a spring.

4. A foam producing dispenser according to claim 1 wherein the terminal end of the incompressible fluid passage has a smaller cross sectional area than the terminal end of the compressible fluid passage.

5. A foam producing dispenser according to claim 2 wherein the terminal end of the incompressible fluid passage has a smaller cross sectional area than the terminal end of the compressible fluid passage.

6. A foam producing dispenser according to claim 3 wherein the terminal end of the incompressible fluid passage has a smaller cross sectional area than the terminal end of the compressible fluid passage.

7. A foam producing dispenser according to claim 2 wherein said means for converting the mixture of fluids in said dispensing passage to a foam prior to exiting said dispensing passage of said housing comprises a multiplicity of screens.

8. A foam producing dispenser according to claim 3 wherein said means for converting the mixture of fluids in said dispensing passage to a foam prior to exiting said dispensing passage of said housing comprises a multiplicity of screens.

9. A foam producing dispenser according to claim 4 wherein said means for converting the mixture of fluids in said dispensing passage to a foam prior to exiting said dispensing passage of said housing comprises a multiplicity of screens.

10. A foam producing dispenser according to claim 4 wherein said means for converting the mixture of fluids in said dispensing passage to a foam prior to exiting said dispensing passage of said housing comprises a multiplicity of screens spaced apart by spacer rings.

11. A foam dispenser for operation in the inverted orientation comprising:

(a) a manually deformable bottle being adapted to contain a compressible fluid in a head space and an incompressible foamable fluid, said bottle having an opening therein;

(b) a housing inserted into said opening in said bottle, said housing having an incompressible fluid passage, a compressible fluid passage and a dispensing passage; said compressible fluid passage extending into said bottle and terminating in said head space when said bottle is in the inverted orientation;

(c) means interposed between said dispensing passage and said incompressible and compressible fluid passages for simultaneously restricting flow from said incompressible fluid passage and said compressible fluid passage to said dispensing passage until a predetermined threshold pressure is developed within said bottle by manual deformation thereof; and (d) means for converting the mixture of fluids in said dispensing passage to a foam prior to exiting said dispensing passage of said housing.

12. A foam dispenser according to claim 11 wherein said means interposed between said dispensing passage and said incompressible and compressible fluid passages for simultaneously restricting flow from said incompressible fluid passage and said compressible fluid passage to said dispensing passage until a predetermined threshold pressure is developed within said bottle by manual deformation thereof comprises a diaphragm biased against a surface having the terminal end of each of said incompressible fluid passage and said compressible fluid passages located therein, and the originating end of said dispensing passage located therein; said diaphragm operating as a valve selectively allowing flow from the incompressible and compressible fluid passages to the dispensing passage only after a threshold pressure is developed within said bottle.

13. A foam dispenser according to claim 12 wherein said means interposed between said dispensing passage and said incompressible and compressible fluid passages for simultaneously restricting flow from said incompressible fluid passage and said compressible fluid passage to said dispensing passage until a predetermined threshold pressure is developed within said bottle by manual deformation thereof further comprises a piston biased against said diaphragm by a spring.

14. A foam producing dispenser according to claim 11 wherein the terminal end of the incompressible fluid passage has a smaller cross sectional area than the terminal end of the compressible fluid passage.

15. A foam producing dispenser according to claim 12 wherein the terminal end of the incompressible fluid passage has a smaller cross sectional area than the terminal end of the compressible fluid passage.

16. A foam producing dispenser according to claim 13 wherein the terminal end of the incompressible fluid passage has a smaller cross sectional area than the terminal end of the compressible fluid passage.

17. A foam producing dispenser according to claim 12 wherein said means for converting the mixture of fluids in said dispensing passage to a foam prior to exiting said dispensing passage of said housing comprises a multiplicity of screens.

18. A foam producing dispenser according to claim 13 wherein said means for converting the mixture of fluids in said dispensing passage to a foam prior to exiting said dispensing passage of said housing comprises a multiplicity of screens.

19. A foam producing dispenser according to claim 14 wherein said means for converting the mixture of fluids in said dispensing passage to a foam prior to exiting said dispensing passage of said housing comprises a multiplicity of screens.

20. A foam producing dispenser according to claim 14 wherein said means for converting the mixture of fluids in said dispensing passage to a foam prior to exiting said dispensing passage of said housing comprises a multiplicity of screens spaced apart by spacer rings.

* * * * *

UNITED STATES PATENT AND TRADEMARK OFFICE

CERTIFICATE OF CORRECTION

PATENT NO. : 5,037,006

DATED : August 6, 1991

INVENTOR(S) : RONALD W. KOCK

It is certified that error appears in the above-identified patent and that said Letters Patent is hereby corrected as shown below:

On the title page, in the REFERENCES CITED section delete "Laavwe" and insert -- Laauwe -- .

Column 2, line 60, after "is" insert -- a -- .

Column 4, line 58, after "intended" delete -- o -- .

Column 5, line 60, delete "5" and insert -- 15 -- .

Column 6, line 30, after "homogenizer" insert -- 50 -- .

Column 7, line 39, delete "thread" and insert -- three -- .

Column 8, line 53, delete "102", first occurrence, and insert -- 106 -- .

Signed and Sealed this

Thirteenth Day of April, 1993

*Attest:*

STEPHEN G. KUNIN

*Attesting Officer*

*Acting Commissioner of Patents and Trademarks*